US006222148B1

(12) United States Patent
Semenov et al.

(10) Patent No.: US 6,222,148 B1
(45) Date of Patent: Apr. 24, 2001

(54) METHOD FOR PRODUCING A MULTILAYER THIN-WALLED BELLOWS OF STAINLESS STEEL

(75) Inventors: Viktor Nikonorovich Semenov; Vladimir Ilich Bobkov; Mikhail Ivanovich Zykov; Valentin Georgievich Polushin; Boris Ivanovich Katorgin; Gennady Grigorievich Derkach; Vladimir Konstantinovich Chvanov; Jury Vasilievich Movchan; Jury Aleksandrovich Pestov; Pavel Ivanovich Ogibalin; Tatiana Mikhailovna Avsenjuk; Alexandr Nikolaevich Vycherov, all of Khimki (RU)

(73) Assignee: Oykrutoe Aktsioneroe Obschestvo "Nauchno-Proizvodstvennoe Obiedinenie"Energomash Imeni Akademika V. P. Glushkon, Moskovskaya Oblast (RU)

( * ) Notice: Subject to any disclaimer, the term of this patent is extended or adjusted under 35 U.S.C. 154(b) by 0 days.

(21) Appl. No.: 09/398,924

(22) Filed: Sep. 16, 1999

(30) Foreign Application Priority Data

Feb. 4, 1999 (RU) ..... 99102054

(51) Int. Cl.[7] ..... B23K 9/09
(52) U.S. Cl. ..... 219/61

(58) Field of Search ..... 219/61, 60 R, 219/137 R, 130.51, 137 PS, 125.11, 125.1; 228/130

(56) References Cited

U.S. PATENT DOCUMENTS 3,405,228 * 10/1968 Polizzano ..... 228/130
3,873,799 * 3/1975 Scheffler et al. ..... 219/61

FOREIGN PATENT DOCUMENTS 1292870 2/1987 (SU) .

OTHER PUBLICATIONS

Burtsev, K.N., "METAL BELLOWS," Mashgiz, State Scientific and Technical Publishing House for the Literature on Mechanical Engineering; pp. 8–11, 1963.

* cited by examiner

*Primary Examiner*—Clifford C. Shaw
(74) *Attorney, Agent, or Firm*—Seed IP Law Group

(57) ABSTRACT

The method for prodicing a multilayer thin-walled bellows of stainless steel consists of manufacturing round billets by welding the sheets, packing the round billets into a multilayer bank, corrugating the bank for forming the multilayer bellows and the bellows tightness testing. The round billets are manufactured of the preliminary cut sheets of given dimensions by their electric arc pulsed gas-shielded welding. The packed multilayer bank is welded from two sides over the end faces and subjected to heat treatment by its heating up to the temperature of 1000–1130° C. in the shielding medium and holding at this temperature during 20–45 minutes with subsequent cooling.

5 Claims, No Drawings

METHOD FOR PRODUCING A MULTILAYER THIN-WALLED BELLOWS OF STAINLESS STEEL

FIELD OF THE INVENTION

The invention relates to the field of machine building, particularly to a method for producing a multilayer thin-walled bellows of stainless steel to be welded with fittings and intended for operation under the extreme conditions.

BACKGROUND OF THE INVENTION

Multilayer thin-walled bellows are widely used in different branches of engineering, for example in the aircraft building, engine building, and oil industry, when it is necessary to secure the movable jointing of pipelines for compensating their relative displacement.

Stainless steel is the most acceptable material for producing such bellows, because it secures their operation under the conditions of high temperature and pressure, corrosive media and vibration.

A method is known for producing a multilayer thin-walled bellows of stainless steel, including manufacturing round billets by their multiple drawing through matrices using punches with a diameter variation, packing the round billets of given diameter into a multilayer bank, its corrugation into a bellows with subsequent operations of surface deforming and heat treatment—subrecrystallization annealing at a temperature of 680±10° C. (the USSR Inventor's Certificate N° 1292870, B21D15/00, 1987).

The operation of drawing each billet before packing into the bank allows to increase wall strength, and the heat treatment after the corrugation allows relieving of residual stress in the metal. However, the billet drawing is a rather labour consuming operation. It reduces abruptly the steel ductility and worsens its structure. This fact may cause the appearance of cracks in the bellows during the corrugation, and thus decrease its serviceability under the extreme operating conditions. Besides, the absence of tightness test for external and internal bellows layers after the corrugation may lead to its destruction during the operation.

Another method is known also for producing a multilayer thin-walled bellows of stainless steel, that includes producing thin round billets, rolled up of the sheets and lap or butt welded, their corrugating using a press with a bellows forming and its tightness test by immersing into the water (K. N. Burtsev "Metal Bellows", Mashgiz, 1963, pp. 8–11).

The above described method is less labour consuming as compared with the previous one and allows to keep the chemical composition and the structure of the initial material during the production process. However, the round billet corrugation just after their manufacturing by welding the sheets may cause the formation of cracks both in the welds and in the steel because of their low ductility and strength. Besides, the bellows tightness testing by immersing into the water is more labour consuming and not easily producible.

SUMMARY OF THE INVENTION

The object of the present invention is to provide a method for producing a multilayer thin-walled welded bellows of stainless steel with improved operating characteristics.

From the engineering point of view, the present invention results in the operation of bellows, produced by this method, without destruction under extreme conditions during a long time period at a temperature of up to 400° C., and the growth of finished product yield due to the tightness testing of the internal and external layers of the bellows.

The above object is achieved by a method for producing a multilayer thin-walled bellows of stainless steel, comprising manufacturing round billets by welding sheets of stainless steel, packing the round billets into a multilayer bank, corrugating the bank with the bellows formation and its tightness testing. According to the invention the manufacturing round billets is made of preliminary cut sheets of stainless steel of given dimensions by their electric arc pulsed gas-shielded welding, the packed multilayer bank is welded from two sides over the end faces and subjected to a heat treatment by its heating in the shielding medium up to the temperature of 1000–1130° C. with holding at this temperature during 20–45 minutes and subsequent cooling.

A pulsed argon-arc welding may be used as the electric arc pulsed gas-shielded welding.

An air medium with the rarefaction of $1\cdot10^{-2}$–$1\cdot10^{-3}$ mm of the mercury column may be used as the shielding medium during the heating.

The multilayer bellows tightness test may be made by pumping an inert gas of high pressure between layers of the multilayer bellows and checking for possible loss of tightness from the side of internal and external surfaces of the multilayer bellows.

A gaseous mixture containing helium may be used as the inert gas, and the tightness test may be made by a helium leak detector.

The growth of ductility for the multilayer bank material is achieved by its heat treatment before corrugating, and sufficient strength is secured by obtaining the welds after the pulsed welding, the strength of which is equal to the strength of the main material.

DETAILED DESCRIPTION OF THE INVENTION

According to the invention, the method is realized in the following way.

The stainless steel sheets are cut to have given dimensions (thickness, width and length). Then they are rolled up into round billets and welded by electric arc pulsed welding. An electric arc pulsed gas-shielded welding may be used as such.

Depending on the required diameter of each billet, a corresponding number of welds is obtained. While using the pulsed argon-arc welding, the welds are obtained with strength equal to the strength of the main material.

From seven to twelve round billets are manufactured for one bellows in such a way. The number of round billets for the bellows depends on the pressure of operating environment during its use. The manufactured round billets are packed into a multilayer bank, the bank is welded from two sides over its end faces and placed into a vacuum furnace, in which it is heat-treated. The bank is heated in the furnace up to the temperature of 1000–1130° C. and held at this temperature during 20–45 minutes depending on the billet dimensions and the thickness of its walls. An air medium with the rarefaction of $1\cdot10^{-2}$–$1\cdot10^{-3}$ mm of the mercury column is used as the shielding medium, but an inert gas, argon for example, may be used also. The cooling is made in the furnace too.

The choice of the heat treatment modes is stipulated by the necessity of obtaining a uniform structure in steel under the indicated temperature; this allows increasing its ductility and preventing the steel component burning fast during the process of holding.

The heating up to the temperature below 1000° C. does not secure the obtaining of a uniform material structure. The heating up to the temperature above 1130° C. causes the grain growth and the loss of material ductility, correspondingly.

The holding period of more than 45 minutes may promote the appearance of separate strengthening phases along the grain boundaries; this will lead to the reduction of material ductility. The holding period of less than 20 minutes will not secure the required uniformity of the material structure.

After the heat treatment, the multilayer bank is subjected to corrugating using a press with the corrugations forming as a result. Then, the corrugations of external and internal layers of the bellows walls are tested for interlayer tightness. It is a pressure test by feeding an inert gas containing helium into the internal space of the bellows. Then it is tested for leakage from the external side and from the side of internal space, correspondingly. Interlayer leakage is tested by a helium leak detector. Any noticeable defect in the metal is detected using helium.

The presence of operation on testing the tightness of the bellows layers allows preventing its destruction during the operation.

The bellows produced by the above-presented method is welded to fittings and subjected to the hydrostatic strength test.

The examples of implementing the proposed method are presented hereafter.

EXAMPLE 1

The cut sheets of steel of H18N10T quality with the thickness of 0.35 mm were inter-jointed by pulsed electric argon-arc welding for forming a round billet having one weld. The weld quality was dye penetrant inspected for revealing the defects. Seven billets of different diameters were produced. They were packed into a bank, welded from two sides over the end faces and heat treated in the air medium at a rarefaction of $1\cdot10^{-2}$ mm of the mercury column. The bank was heated up to the temperature of 1000° C. and held during 20 minutes. Then it was cooled in the furnace. The heat treatment allowed the steel ductility growing. The relative elongation (δ) increased by up to 50%. The bank was corrugated after that by a single action of hydraulic press under the pressure of 145 atm for forming a bellows, that was subjected to the test on the interlayer tightness of corrugations by pumping an inert gas containing up to 40% of helium. The loss of tightness was not discovered for the bellows.

The bellows manufactured by the above method was welded to fittings and subjected to hydrostatic strength test. No bellows failures were discovered. After that it was tested in the oxygen environment under the temperature of up to 350° C., vibration and pressure of 120 atm. The tests showed that it was efficient under these conditions during a period of 60 minutes.

EXAMPLE 2

The cut sheets of the same steel, as in the Example 1, of 0.35 mm in thickness were inter-jointed by pulsed argon-arc welding for forming a round billet. The weld quality was tested, and the strength of welds and of the main material was determined. Their strength was the same and comprised up to 62 kgf/mm$^2$. Twelve billets were made. Then they were packed into a multilayer bank, that was welded from two sides over the end faces and subjected to heat treatment in a vacuum furnace at rarefaction of $1\cdot10^{-3}$ mm of the mercury column. The bank was heated up to the temperature 1130° C. and held during 45 minutes. The cooling was made similarly to the Example 1. After the heat treatment the relative steel elongation comprised up to 50%. The bank corrugating into a bellows, its tightness testing after welding to fittings and strength testing were made similarly to the Example 1. No bellows failures were discovered. The bellows did not fail also during its testing under extreme conditions: oxygen environment, vibration, temperature of 400° C. and pressure of 300 atm during 60 minutes.

The above-presented method for producing a multilayer thin-walled bellows is intended for the application in the rocket engine building. It may be used also in other fields of engineering when it is necessary to produce dynamic connection seals for the conditions of high and cryogenic temperatures at a presence of chemically active media, in chemical industry and cryogenic engineering for example.

We claim:

1. A method for producing a multilayer thin-walled bellows of stainless steel comprising the steps of:

cutting sheets of stainless steel of given dimensions;

manufacturing round billets by electric arc pulsed gas-shielded welding of said cut sheets;

packing said round billets into a multilayer bank, having end faces, welding said multilayer bank from two sides over said end faces;

heat treating said multilayer bank, including its heating in the shielding medium up to the temperature of 1000–1130° C. holding at this temperature during 20–45 minutes and subsequent cooling;

corrugating said heat treated multilayer bank resulting in formation of the multilayer bellows having internal and external surfaces;

tightness testing said multilayer bellows.

2. The method according to claim 1, wherein said electric arc pulsed gas-shielded welding is a pulsed argon-arc welding.

3. The method according to claim 1, wherein said shielding medium used during said heating said multilayer bank is an air medium with the rarefaction of $1\cdot10^{-2}$–$1\cdot10^{-3}$ mm of the mercury column.

4. The method according to claim 1, wherein said multilayer bellows tightness testing includes pumping an inert gas of high pressure between layers of said multilayer bellows and checking possible loss of tightness from the side of said internal and external surfaces of said multilayer bellows.

5. The method according to claim 4, wherein said inert gas is a gaseous mixture containing helium and said tightness testing said multilayer bellows is made by a helium leak detector.

* * * * *